United States Patent [19]

Takahashi et al.

[11] Patent Number: 4,570,207

[45] Date of Patent: Feb. 11, 1986

[54] LUMINOUS INDICATING DEVICE

[75] Inventors: Hisae Takahashi, Tokyo; Tatsuro Yoshinaga, Ageo; Akio Mitomo, Noda, all of Japan

[73] Assignees: Sho-Bond Construction Co., Ltd., Tokyo, Japan; Hitachi Heating Appliances Co., Ltd., both of Tokyo, Japan

[21] Appl. No.: 669,425

[22] Filed: Nov. 8, 1984

Related U.S. Application Data

[63] Continuation of Ser. No. 517,033, Jul. 25, 1983, abandoned.

[30] Foreign Application Priority Data

Oct. 20, 1982 [JP] Japan ..... 57-183854

[51] Int. Cl.[4] ..... H01H 47/00

[52] U.S. Cl. ..... 362/152; 362/153; 362/800

[58] Field of Search ..... 362/153, 152, 145, 800, 362/24, 27, 26, 311

[56] References Cited

U.S. PATENT DOCUMENTS

| | | | |
|---|---|---|---|
| 2,093,642 | 9/1937 | Nystuen | 362/145 |
| 2,162,302 | 6/1939 | Greene | 362/145 |
| 2,990,177 | 6/1961 | Hutchison | 362/153 |
| 3,163,949 | 1/1965 | Gley | 362/26 |
| 4,211,955 | 7/1980 | Ray | 362/800 |
| 4,223,377 | 9/1980 | Williams | 362/145 |

FOREIGN PATENT DOCUMENTS

| | | | |
|---|---|---|---|
| 1516677 | 7/1970 | Fed. Rep. of Germany . | |
| 1915946 | 12/1970 | Fed. Rep. of Germany . | |
| 1957567 | 2/1971 | Fed. Rep. of Germany . | |
| 2025291 | 9/1970 | France . | |
| 2393109 | 12/1978 | France . | |
| 372443 | 6/1939 | Italy | 362/152 |
| 54-127658 | 10/1979 | Japan . | |
| 434338 | 4/1967 | Switzerland . | |
| 118739 | 9/1918 | United Kingdom | 362/145 |
| 1599169 | 9/1981 | United Kingdom . | |

*Primary Examiner*—Magdalen Y. C. Moy

*Attorney, Agent, or Firm*—Antonelli, Terry & Wands

[57] ABSTRACT

A luminous indicating device and comprising at least one luminous block adapted to be buried in a road surface so that a radiating surface thereof is flush with the road surface. The luminous block is formed of a composite material block and at least one luminous element which is formed of a transparent material block and a light source buried at one end portion of the block to radiate light from the other end surface of the block. The luminous block is buried in the composite material block so that the other end surface of said transparent material block is flush with a top surface of the composite material block.

4 Claims, 10 Drawing Figures

LUMINOUS INDICATING DEVICE

This is a continuation of application Ser. No. 517,033, filed July 25, 1983, and now abandoned.

The present invention relates to a luminous block and, more particularly, to a luminous indicating device incorporating the luminous block, with the luminous indicating device being adapted to be used for various types of indication on roads.

Generally, a stop line, a pedestrian crossing zone, and central isolation zone on roads have been indicated by drawing lines on roads; however, since the lines are simply drawn on the road surface, the lines are hard to see at night, and recently luminous devices have been employed for providing a desired indication.

In for example, Japanese Utility Model Application Laid-Open No. 74192/1974, it has been proposed to provide a number of blinking lights buried on one or both sides of a pedestrian cross, while Japanese Utility Model Application Laid-Open No. 81110/1980 proposes a light sourceconnected through an optical transmission medium to a sign post buried on a road distance from the light source, and Japanese Utility Model Laid-Open No. 54422/1973 proposes providing blocks having a fluorescent material which are adapted to be buried in the surface of the roads. Additionally, in Japanese Utility Model Application Laid-Open No. 43530/1975, a light source for a blinking signal is proposed, with the light source being connected through an optical fiber to a light radiating end buried along a pedestrian crossing. However, a luminous device simply using light bulbs or the like must be protected at an upper part or periphery thereof by a rigid material and must be projected from the paved road surface when used as an indicating device on road. However, the provision of a rigid protective material results in forming an obstruction over which a vehicle must travel thereby generating road noise. Moreover, since a buried block of signpost is generally not abraded to the same extent as is the paved road surface in which it is buried, a step occurs to cause the same troubles.

The present invention is to provide a luminous indicating device for roads in which the above defects are obviated.

In accordance with the present invention luminous elements provided, with each luminous element being formed of a light source and an abradable transparent material buried in an abradable composite material block to form a luminous block. At least a single luminous block is buried in a paved road so that a top thereof is substantially flushed with the road surface, thereby making a luminous indicating device for road.

The above and other objects, features and advantages of the present invention will be more clear from the following description with reference to the accompanying drawings, in which.

Figure 1:
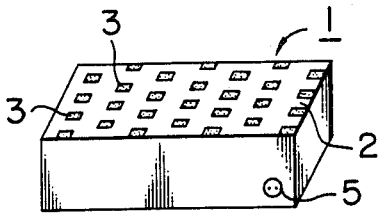
FIG. 1 is a perspective view of a luminous block of one embodiment of this invention.
Figure 2:
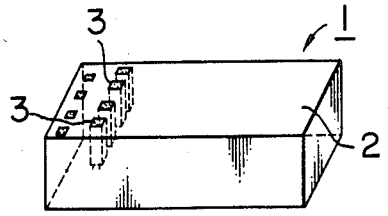
FIG. 2 is a perspective view of the luminous block of FIG. 1, showing the condition in which the luminous block is buried in a composite material.
Figure 3:
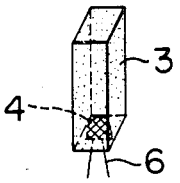
FIG. 3 is a schematical perspective view of a luminous element in FIG. 1.

Referring now to the drawings wherein like reference numerals are used throughout the various views to designate like parts and, more particularly, to FIGS. 1–3, according to these figures, a luminous block generally designated by the reference numeral 1, is formed of luminous elements 3 buried, in a composite material block 2 of an appropriate size which can be worn away by running vehicles. For example, the material block 2 may be made of resin mortar in such a manner that radiant surfaces of the luminous elements 3 are flush with the top of the composite material block 2. The luminous element 3 is formed by a block of an appropriate size made of a transparent material which can be worn away, such as, for example, acrylic resin or vinyl chloride resin, and a light source 4 such as, for example, a light-emitting diode is buried in the transparent material block. The acrylic resin and vinyl chloride resin sometimes cause diffused reflection of light when worn away and therefore, to prevent this it is recommended to use a necessary diffusing material in the resin. However, a certain degree of diffused reflection of light due to abrasion is very effective for luminous indicating devices, as will be described later. Although normally a plurality of luminous element 3 are buried at suitable distances in the composite material block 2 which constitutes the luminous block 1, a single luminous element can of course be buried in the material block 2 of a certain size. The size of luminous block 1 can be determined appropriately by considering the indicating line to be provided on a road. Lead wires 6 extend from the respective luminous elements 3, with the respective lead wires 6 being connected to an outlet 5 for enabling a supply of power to the light source 4 by a commercial power supply.

Figure 4:
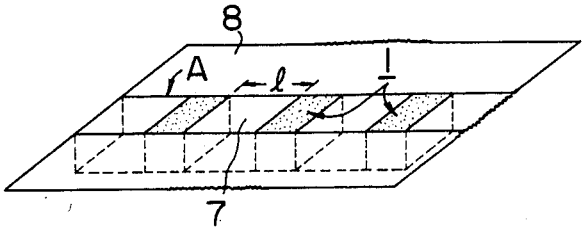
FIG. 4 is an explanatory diagram for explaining a luminous indicating device of this invention using luminous blocks in the stop line on road.
Figure 5:
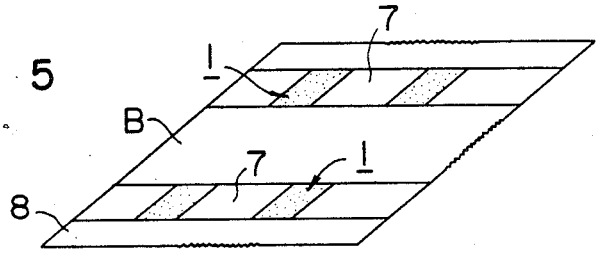
FIG. 5 is an explanatory diagram for explaining a luminous indicating device using luminous blocks on a pedestrian crossing of road.

In FIG. 4, a plurality of luminous blocks 1 are buried in a paved road surface 8 at equal distances l across the road in such a manner that the surfaces of the blocks 1 are flush with the paved road surface 8 so as to form, for example, a stop line A. In FIG. 5, a plurality of luminous blocks 1 are used on a pedestrian crossing B. To install the luminous blocks 1, for example, the paved road surface is cut away along the stop line a or the indicating line of the pedestrian crossing B, and a plurality of luminous blocks 1 are buried at certain distances therealong, with the remaining spaces of the cut-away portion being filled with colored resin mortar to fix the blocks 1.

Figure 6:
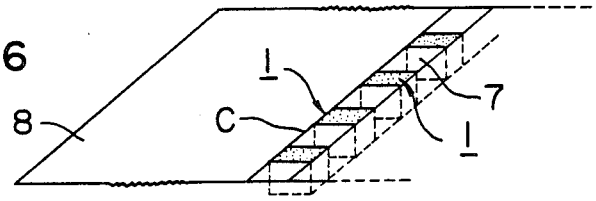
FIGS. 6 and 7 show applications of luminous blocks.
Figure 7:
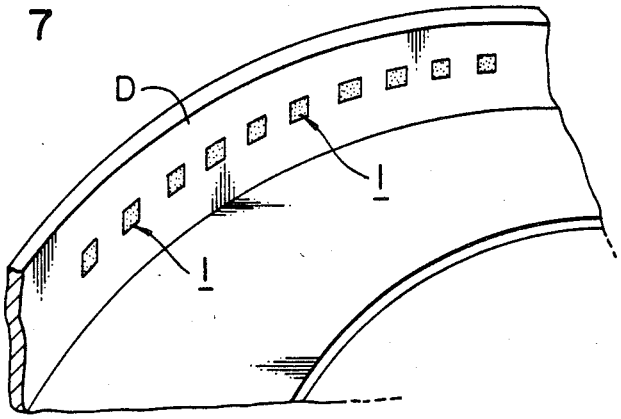

As shown in FIGS. 6 and 7, the luminous block 1 can be applied to other different purposes, such as, for example, to provide a guiding illumination on side walls D, to indicate a center isolating zone C of road, or outline a curve in the road. Additionally, the luminous block 1 can be installed at the entrance and exit of a garage or parking zone so as to automatically blink when a car enters or exits, informing pedestrians that the car is coming. It is of course possible to slightly project the radiation surface of the luminous block 1 from the surface of the composite material block 2, depending on where the luminous block 1 is used.

Figure 8:
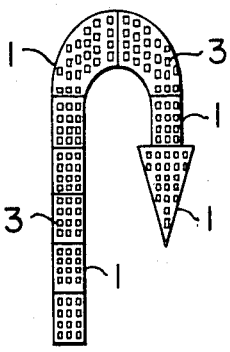
FIG. 8 is a plan view of a U-turn prohibition signpost using the luminous block of this invention.
Figure 8:
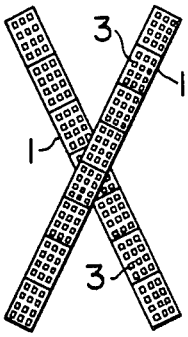

Additionally, a signpost for U-turn prohibition as shown in FIG. 8 can be made by burying a number of luminous blocks 1 on road surface, and although not shown, it is possible to indicate a figure for maximum limited speed.

The electrical connection and control system for the luminous blocks 1 according to this invention may be achieved by known methods. For example, the control system may be of a continuous lighting type, blinking type, or direction indicating and blinking type, and the operation of the luminous blocks 1 may be accomplished by timers, Cds, vehicle detectors or other means. The power supply to be used may be 2 to 5V DC power source, or may be a solar battery for converting solar energy to electrical power.

Figure 9:
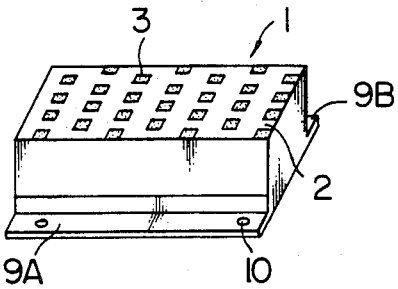
FIGS. 9 and 10 are perspective views of luminous blocks electrically wired.
Figure 10:
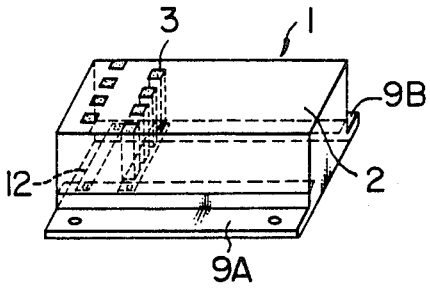

As shown in FIGS. 9 and 10 conductive electrodes 9A, 9B are mounted on the luminous block 1 and serve as mounting supports for enabling a fixing the luminous block 1 by bolts threaded through apertures 10 provided therein. By virtue of the provision of the electrodes 9A and 9B which respectively serve as an anode and a cathode not only is the mounting of the luminous blocks 1 facilitated but it is also possible to quickly check or monitor the operation of the luminous block 1. The plurality of lead wires 6 are connected to a printed wiring board 12, with both ends of the wiring board 12 being connected to the electrodes 9A and 9B, so that a plurality luminous elements 3, for example, four in FIG. 10, can be simultaneously connected by once connecting and fixing the printed wiring board 12 to the electrodes 9A and 9B.

Although the top of the luminous element together with the top of the composite material block 2 is abraded by vehicle tires, the light ray from the light source 4 is transmitted within the luminous element 3 without trouble and is moderately scattered from its top, or diffusely radiated in various different directions by the minutely irregular surface of the luminous element 3. This diffuse radiation greatly improves the visibility of the luminous block 1.

Thus, the luminous block 1 of this invention can have wide application, and a luminous indicating device using the luminous block 1 is able to better function as a signpost on road. Since the luminous block 1 itself can be abraded and is transparent, when used in a signpost such as stop line or pedestrian crossing it is able to be buried in the paved road so that the top thereof is flush with the surface of the road. In this case, when the surface of the paved road is abraded by vehicle traffic, the top of the luminous block 1 is also similarly abraded thereby, resulting in no step being caused on the road. Thus, when buried in the road as described above, the luminous block not only creates no problems for vehicle traffic, but also does not produce any noise as the vehicle travels over the luminous blocks 1. Moreover, since the light source 4 is buried in the transparent-material block and fixed therein, it is substantially unnecessary to care about breakage of the light source 4.

We claim:

1. A luminous indicating device comprising at least one luminous block which is adapted to be buried in a road surface so that an upper radiating surface thereof is flush with the road surface, said luminous block being formed as an abradable composite material block including at least one luminous element formed of an abradable light passable material block, at least one high intensity light emitting diode disposed at one end surface of the light passable material block for radiating light through the other end surface of the light passable material block, said light passable material block being disposed in said composite material block so that the other end surface of the light passage material block is disposed flush with a top surface of said composite material block, and wherein said light passable material block is made of an acrylic resin or vinyl chloride resin and said composite material block is made of a resin mortar.

2. A luminous indicating device according to claim 1, wherein a plurality of luminous elements are disposed, said luminous block, with each luminous element including at least one high intensity light emitting diode, and wherein said luminous block further includes a printed wiring board means for simultaneously supplying power to said light emitting diodes, said printed wiring board means being connected to lead wires of each of said light emitting diodes, and mounting means for fixing said luminous block in place, said mounting means serving as electrodes to be connected to said printed wiring board means.

3. A luminous indicating device according to claim 1, wherein said resin is an epoxy type resin.

4. A luminous indicating device according to claim 1, wherein a degree of wear of the light passable material block and the composite material block is substantially equal to a degree of wear of a material forming the road surface.

* * * * *